US006508448B1

(12) United States Patent
Stewart

(10) Patent No.: US 6,508,448 B1
(45) Date of Patent: Jan. 21, 2003

(54) ADJUSTABLE DRYWALL SUPPORT APPARATUS

(76) Inventor: Dennis Stewart, 13829 Kinbrook St., Sylmar, CA (US) 91342

( * ) Notice: Subject to any disclaimer, the term of this patent is extended or adjusted under 35 U.S.C. 154(b) by 0 days.

(21) Appl. No.: 09/802,566

(22) Filed: Mar. 9, 2001

(51) Int. Cl.[7] ..... E04G 25/08

(52) U.S. Cl. ..... 248/354.1; 248/125.8; 248/161; 248/351; 52/127.1; 52/749.1; 52/749.14; 414/11

(58) Field of Search ..... 248/125.8, 129, 248/101, 157, 351, 354.1, 354.3; 52/125.1, 127.1, 749.13, 749.14, 749.1; 414/11

(56) References Cited

U.S. PATENT DOCUMENTS

| | | | | | |
|---|---|---|---|---|---|
| 911,893 | A | * | 2/1909 | Massey | 248/618 |
| 1,229,976 | A | * | 6/1917 | Klais | 269/74 |
| 3,910,421 | A | * | 10/1975 | Panneton | 414/11 |
| 3,930,645 | A | | 1/1976 | Anderson | |
| 4,036,475 | A | * | 7/1977 | Singleton | 254/133 R |
| 4,120,484 | A | | 10/1978 | Zimmer | |
| 4,339,219 | A | * | 7/1982 | Lay | 414/11 |
| 4,560,031 | A | * | 12/1985 | Dixon et al. | 182/129 |
| 4,600,348 | A | * | 7/1986 | Pettit | 414/11 |
| 4,733,844 | A | | 3/1988 | Molloy | |
| 4,905,944 | A | * | 3/1990 | Jost et al. | 248/125.8 |
| 5,129,774 | A | | 7/1992 | Balseiro et al. | |
| 5,322,403 | A | * | 6/1994 | Herde | 414/11 |
| 5,344,169 | A | * | 9/1994 | Pryor et al. | 280/79.3 |
| 5,640,826 | A | * | 6/1997 | Hurilla, Jr. | 52/749.14 |
| D389,980 | S | | 1/1998 | Friz | |
| 5,979,854 | A | * | 11/1999 | Lundgren et al. | 248/354.3 |
| 6,213,434 | B1 | * | 4/2001 | Reichanadter, Jr. | 248/125.8 |
| 6,244,810 | B1 | * | 6/2001 | Reyes | 414/11 |

* cited by examiner

*Primary Examiner*—Leslie A. Braun
*Assistant Examiner*—Deborah M. Brann

(57) ABSTRACT

An adjustable drywall support apparatus for holding a gypsum wallboard in place as it is being installed at ceiling level. The adjustable drywall support apparatus includes a support assembly including an elongate tubular member and a shaft member being telescopingly disposed in the elongate tubular member; and also includes a cross member assembly including a tubular main cross member being securely attached to the support assembly and being adapted to engage and support a drywall.

2 Claims, 3 Drawing Sheets

ADJUSTABLE DRYWALL SUPPORT APPARATUS

BACKGROUND OF THE INVENTION

1. Field of the Invention

The present invention relates to an adjustable drywall support and more particularly pertains to a new adjustable drywall support apparatus for holding a gypsum wallboard in place as it is being installed at ceiling level.

2. Description of the Prior Art

The use of an adjustable drywall support is known in the prior art. More specifically, an adjustable drywall support heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,129,774; U.S. Pat. No. 4,733,844; U.S. Pat. No. 4,120,484; U.S. Pat. No. 3,910,421; U.S. Pat. No. 3,930,645; and U.S. Pat. No. Des. 389,980.

While these devices fulfill their respective, particular objectives and requirements, the aforementioned patents do not disclose a new adjustable drywall support apparatus. The inventive device includes a support assembly including an elongate tubular member and a shaft member being telescopingly disposed in the elongate tubular member; and also includes a cross member assembly including a tubular main cross member being securely attached to the support assembly and being adapted to engage and support a drywall.

In these respects, the adjustable drywall support apparatus according to the present invention substantially departs from the conventional concepts and designs of the prior art, and in so doing provides an apparatus primarily developed for the purpose of holding a gypsum wallboard in place as it is being installed at ceiling level.

SUMMARY OF THE INVENTION

In view of the foregoing disadvantages inherent in the known types of adjustable drywall support now present in the prior art, the present invention provides a new adjustable drywall support apparatus construction wherein the same can be utilized for holding a gypsum wallboard in place as it is being installed at ceiling level.

The general purpose of the present invention, which will be described subsequently in greater detail, is to provide a new adjustable drywall support apparatus which has many of the advantages of the adjustable drywall support mentioned heretofore and many novel features that result in a new adjustable drywall support apparatus which is not anticipated, rendered obvious, suggested, or even implied by any of the prior art adjustable drywall support, either alone or in any combination thereof.

To attain this, the present invention generally comprises a support assembly including an elongate tubular member and a shaft member being telescopingly disposed in the elongate tubular member; and also includes a cross member assembly including a tubular main cross member being securely attached to the support assembly and being adapted to engage and support a drywall.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new adjustable drywall support apparatus which has many of the advantages of the adjustable drywall support mentioned heretofore and many novel features that result in a new adjustable drywall support apparatus which is not anticipated, rendered obvious, suggested, or even implied by any of the prior art adjustable drywall support, either alone or in any combination thereof.

It is another object of the present invention to provide a new adjustable drywall support apparatus which may be easily and efficiently manufactured and marketed.

It is a further object of the present invention to provide a new adjustable drywall support apparatus which is of a durable and reliable construction.

An even further object of the present invention is to provide a new adjustable drywall support apparatus which is susceptible of a low cost of manufacture with regard to both materials and labor, and which accordingly is then susceptible of low prices of sale to the consuming public, thereby making such adjustable drywall support apparatus economically available to the buying public.

Still yet another object of the present invention is to provide a new adjustable drywall support apparatus which provides in the apparatuses and methods of the prior art some of the advantages thereof, while simultaneously overcoming some of the disadvantages normally associated therewith.

Still another object of the present invention is to provide a new adjustable drywall support apparatus for holding a gypsum wallboard in place as it is being installed at ceiling level.

Yet another object of the present invention is to provide a new adjustable drywall support apparatus which includes a support assembly including an elongate tubular member and a shaft member being telescopingly disposed in the elongate tubular member; and also includes a cross member assembly including a tubular main cross member being securely attached to the support assembly and being adapted to engage and support a drywall.

Still yet another object of the present invention is to provide a new adjustable drywall support apparatus that is easy and convenient to use with little effort and saves the user substantial time.

Even still another object of the present invention is to provide a new adjustable drywall support apparatus that eliminates back injuries and strain to one's back while putting upon wallboards.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
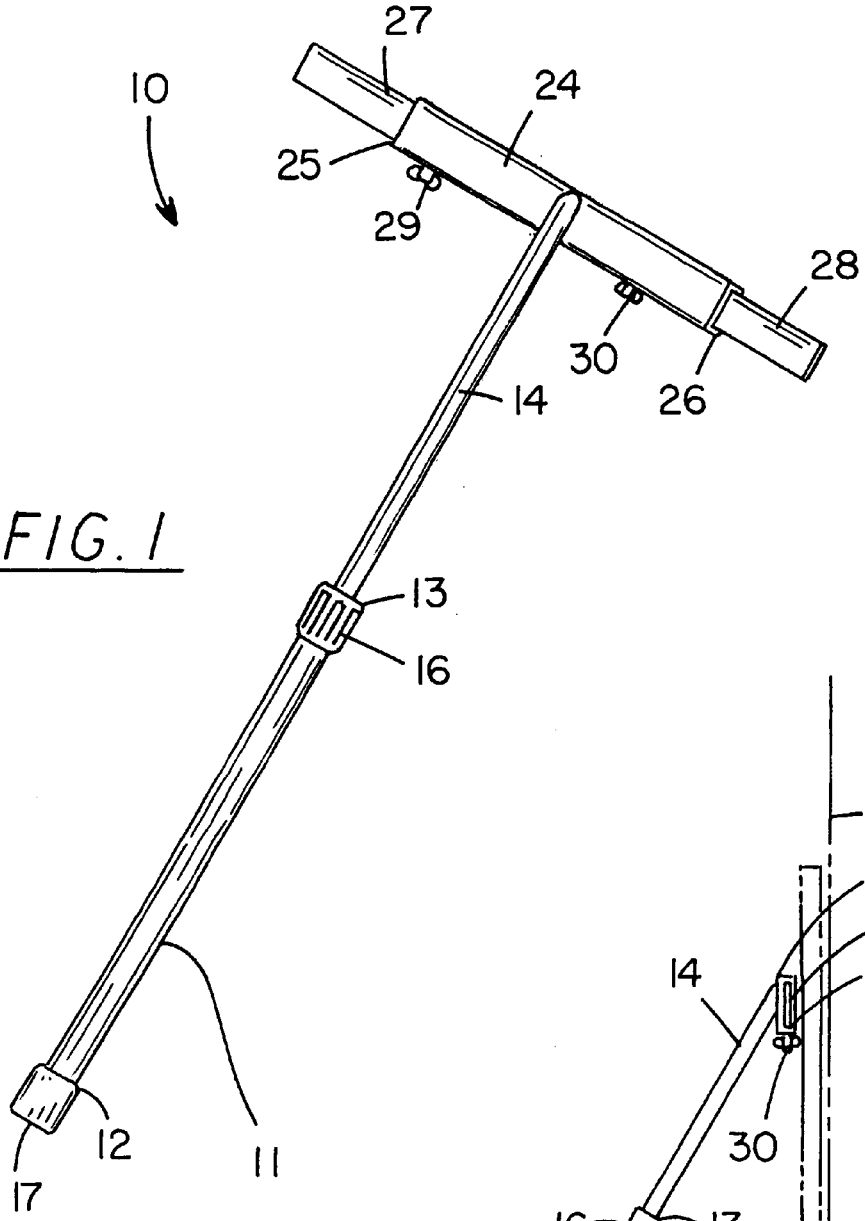
FIG. 1 is a perspective view of a first embodiment of a new adjustable drywall support apparatus according to the present invention.
Figure 2:
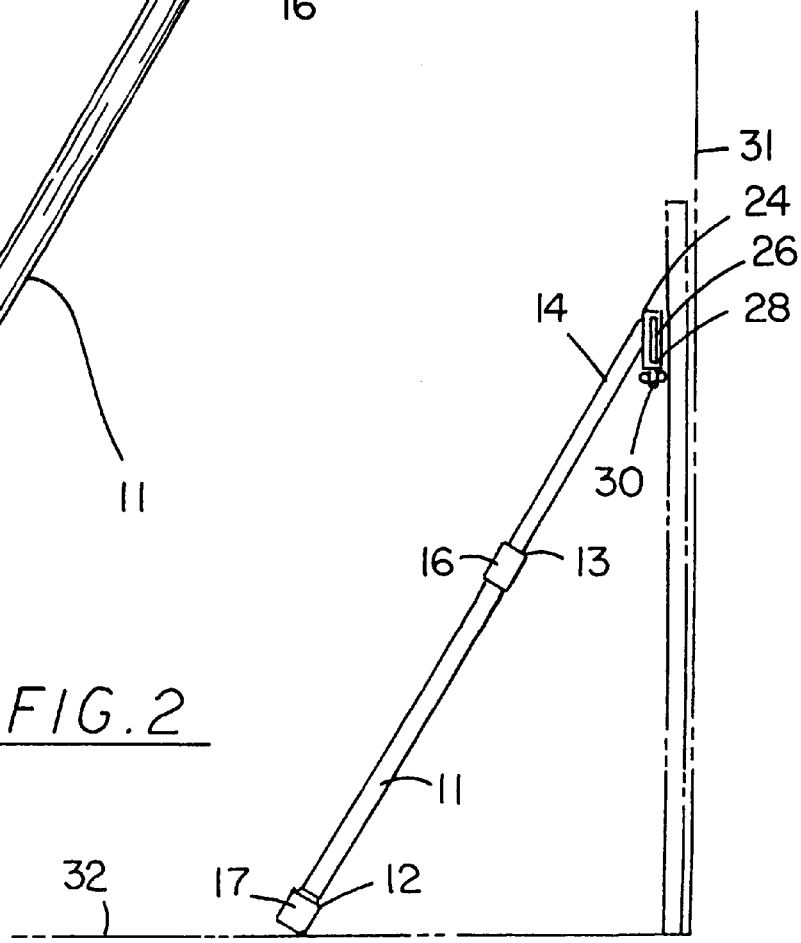
FIG. 2 is a side elevational view of the first embodiment of the present invention shown in use.
Figure 3:
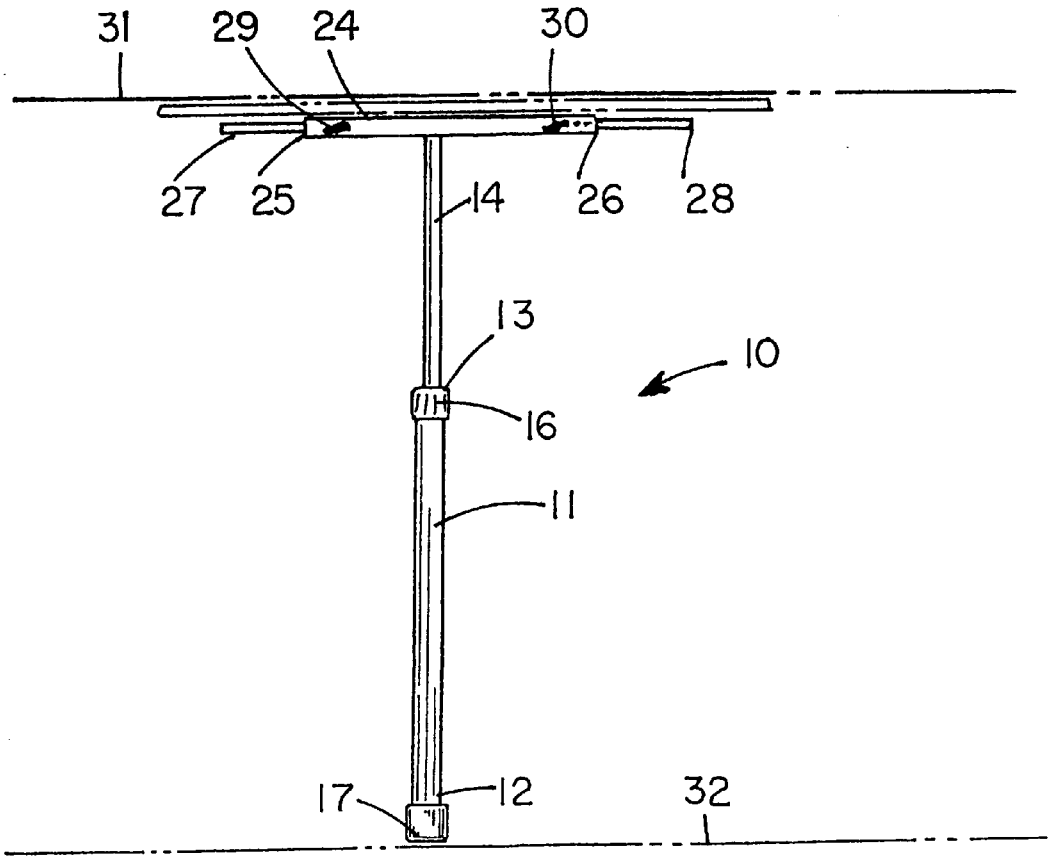
FIG. 3 is a front elevational view of the first embodiment of the present invention.
Figure 4:
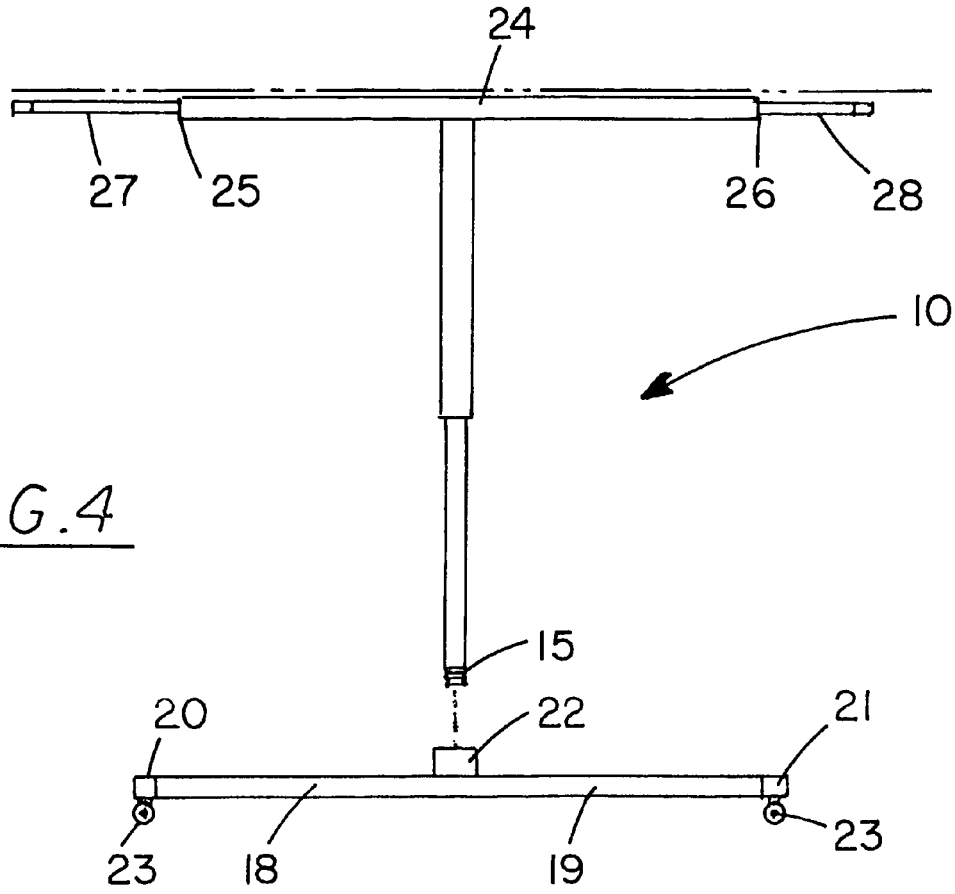
FIG. 4 is an exploded front elevational view of a second embodiment of the present invention.
Figure 5:
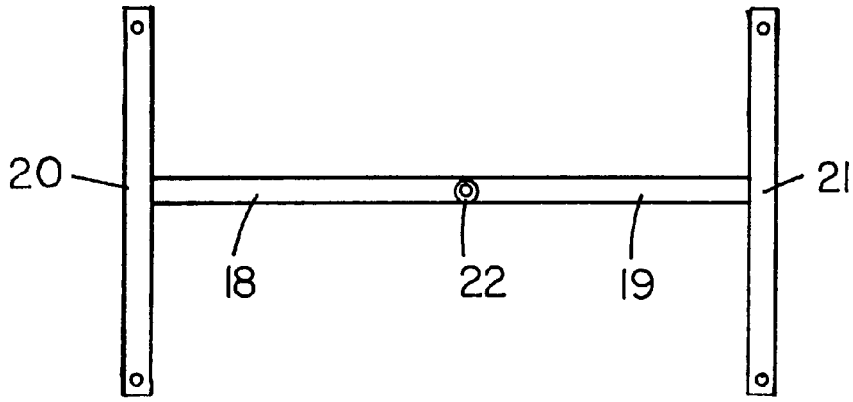
FIG. 5 is a top plan view of the second embodiment of the present invention.

With reference now to the drawings, and in particular to FIGS. 1 through 5 thereof, a new adjustable drywall support apparatus embodying the principles and concepts of the present invention and generally designated by the reference numeral 10 will be described.

As best illustrated in FIGS. 1 through 5, the adjustable drywall support apparatus 10 generally comprises a support assembly including an elongate tubular member 11 and a shaft member 14 being telescopingly disposed in the elongate tubular member 11. The elongate tubular member 11 has a closed end 12 and an open end 13 and a bore extending therein through the open end 13. The shaft member 14 is movably disposed in and from the bore of the elongate tubular member 11 through the open end 13 thereof. The support assembly further includes a fastening member 16 being conventionally disposed at the open end 13 of the elongate tubular member 11 and being engagable with the shaft member 14 to secure the shaft member 14 at selected extended positions from the elongate tubular member 11.

A cross member assembly includes a tubular main cross member 24 being securely and conventionally attached to the support assembly and being adapted to engage and support a drywall 31. The cross member assembly further includes a pair of elongate extension members 27,28 being movably disposed in and from opposite ends 25,26 of the tubular main cross member 24 to essentially lengthen the tubular main cross member 24 when needed. The cross member assembly also includes fasteners 29,30 being threaded into a side wall of the tubular main cross member 24 and being engagable to the elongate extension members 27,28 to secure the elongate extension members 27,28 at selected positions from the tubular main cross member 24. The tubular main cross member 24 has a length of approximately two feet, and the elongate extension members 27,28 have a length of approximately one foot.

As a first embodiment, the support assembly also includes a non-slip cap member 17 being conventionally disposed upon the closed end 12 of the elongate tubular member 11 to prevent the elongate tubular member 11 from slipping upon a ground 32.

As a second embodiment, the support assembly also includes a support base 18 having an elongate member 19, a pair of elongate end cross members 20,21 being securely and conventionally disposed at ends of the elongate member 19, a boss 22 being conventionally and centrally-disposed upon the elongate member 18, and wheel members 23 being conventionally attached at ends of the end cross members 20,21 to allow for easy movement of the adjustable drywall support apparatus 10. The shaft member 14 includes a first end 15 which is threaded into the boss 22.

In use, the user extends and locks the shaft member 14 at a selected position from the elongate tubular member 11 and, if needed, extends and locks the elongate extension members 27,28 from the tubular main cross member 24, and then places the cross member assembly against the drywall 31 with the support assembly being situated upon the ground 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable drywall support apparatus comprising:

a support assembly including an elongate tubular member with a base end and a shaft member being telescopingly disposed in said elongate tubular member, said elongate tubular member having a closed end and an open end and a bore extending therein through said open end, said shaft member being movably disposed in and from said bore of said elongate tubular member through said open end thereof, said support assembly further including a fastening member being disposed at said open end of said elongate tubular member and being engagable with said shaft member to secure said shaft member at selected extended positions from said elongate tubular member; and a cross member assembly for supporting a sheet of drywall and including a tubular main cross member having an upper side and a lower side, wherein said lower side of said cross member is mounted on an upper end of said shaft member and is orientated such that a longitudinal axis of said cross member is substantially perpendicular to a longitudinal axis of said shaft member, wherein a plane of said lower side of said cross member is angled with respect to the longitudinal axis of said shaft member such that said upper side of said cross member is alignable with a vertical support surface when said support assembly is angled away from the vertical support surface for holding the sheet of drywall in position until secured by a user, said cross member assembly further including a pair of elongate extension members being movably disposed in and from opposite ends of said tubular main cross member to essentially lengthen said tubular main cross member when needed, said cross member assembly also including fasteners being threaded into a side wall of said tubular main cross member and being engagable to said elongate extension members to secure said elongate extension members at selected positions from said tubular main cross member, said tubular main cross member having a length of approximately two feet, and the elongate extension members having lengths of approximately one foot.

2. An adjustable drywall support apparatus as described in claim 1, wherein said support assembly also includes a non-slip cap member being removably mountable on said base end of said elongate tubular member to prevent said elongate tubular member from slipping upon port surface.

* * * * *